US011395787B2

(12) United States Patent
Garza Muguerza

(10) Patent No.: US 11,395,787 B2
(45) Date of Patent: Jul. 26, 2022

(54) MEDICATION REMINDER SYSTEM

(71) Applicant: Joaquin Garza Muguerza, San Antonio, TX (US)

(72) Inventor: Joaquin Garza Muguerza, San Antonio, TX (US)

( * ) Notice: Subject to any disclaimer, the term of this patent is extended or adjusted under 35 U.S.C. 154(b) by 129 days.

(21) Appl. No.: 16/540,411

(22) Filed: Aug. 14, 2019

(65) Prior Publication Data

US 2020/0054532 A1 Feb. 20, 2020

Related U.S. Application Data

(60) Provisional application No. 62/718,384, filed on Aug. 14, 2018.

(51) Int. Cl.

| | |
|---|---|
| ***B65D 83/04*** | (2006.01) |
| ***A61J 7/04*** | (2006.01) |
| ***A61J 1/03*** | (2006.01) |

(52) U.S. Cl.
CPC .. *A61J 7/04* (2013.01); *A61J 1/03* (2013.01)

(58) Field of Classification Search
CPC ..... A61J 1/03; A61J 7/04; B65D 5/4212
USPC ..... 206/459.1, 459.5, 528, 534, 540; 116/306, 308, 309, 311, 315; 215/230
See application file for complete search history.

(56) References Cited

U.S. PATENT DOCUMENTS

| | | | | | |
|---|---|---|---|---|---|
| 2,450,949 | A * | 10/1948 | Gattuccio | A61J 7/04 | 116/308 |
| 4,802,438 | A * | 2/1989 | DeJonge | A61J 7/04 | 116/308 |
| 5,662,224 | A * | 9/1997 | Nogues | A61J 7/04 | 206/534 |
| 7,665,611 | B2 * | 2/2010 | Koch | A61J 7/04 | 206/534 |
| 9,021,981 | B2 * | 5/2015 | Raiti de Boyles | A61J 7/04 | 116/308 |
| 9,199,766 | B1 * | 12/2015 | Kosierkiewicz | B65D 25/00 | |
| 9,855,193 | B2 * | 1/2018 | O'Doherty | A61J 7/04 | |
| 2003/0192468 | A1 * | 10/2003 | Goertzen | G09F 11/23 | 116/309 |
| 2006/0180566 | A1 * | 8/2006 | Mataya | A61J 7/04 | 215/230 |
| 2015/0060387 | A1 * | 3/2015 | Ammar | A61J 1/03 | 215/230 |

* cited by examiner

*Primary Examiner* — Luan K Bui
(74) *Attorney, Agent, or Firm* — Kimberly McLean; McLean Law LLC

(57) ABSTRACT

A medication reminder system includes a container and a reminder ring. The container includes a plurality of protuberances located along the neck area of which creates a groove between each protuberance and the container includes indicia. The indicia are time indicators located at a rotational position along a circumference of the shoulder area. The ring is rotatably engaged to the neck area of the container to indicate a time for a next medication dosage. The ring has a plurality of internal locking members which each rotationally engage at least one of the plurality of protuberances to lock the ring in a desired rotated position. The ring has at least one external member which points to indicia located at a shoulder area of the container.

6 Claims, 3 Drawing Sheets

MEDICATION REMINDER SYSTEM

CROSS-REFERENCE TO RELATED APPLICATION

This application claims priority benefit of U.S. Provisional Application 62/718,384 filed on Aug. 14, 2018, the disclosure of which is incorporated herein by reference in its entirety.

FIELD OF THE INVENTION

Embodiments described herein generally relate to reminder systems, and more particularly to a medication reminder system.

BACKGROUND OF THE INVENTION

For many reasons, it is sometimes difficult for an individual to remember if he/she took a particular medication. This is especially true when an individual has to take a number of different medications. In some circumstances, it is extremely important that only a specified dosage of a particular medication is taken as prescribed. Hence, it is important for an individual to remember when to take a next medication dosage. Thus, there is a need in the art for efficient medication management.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
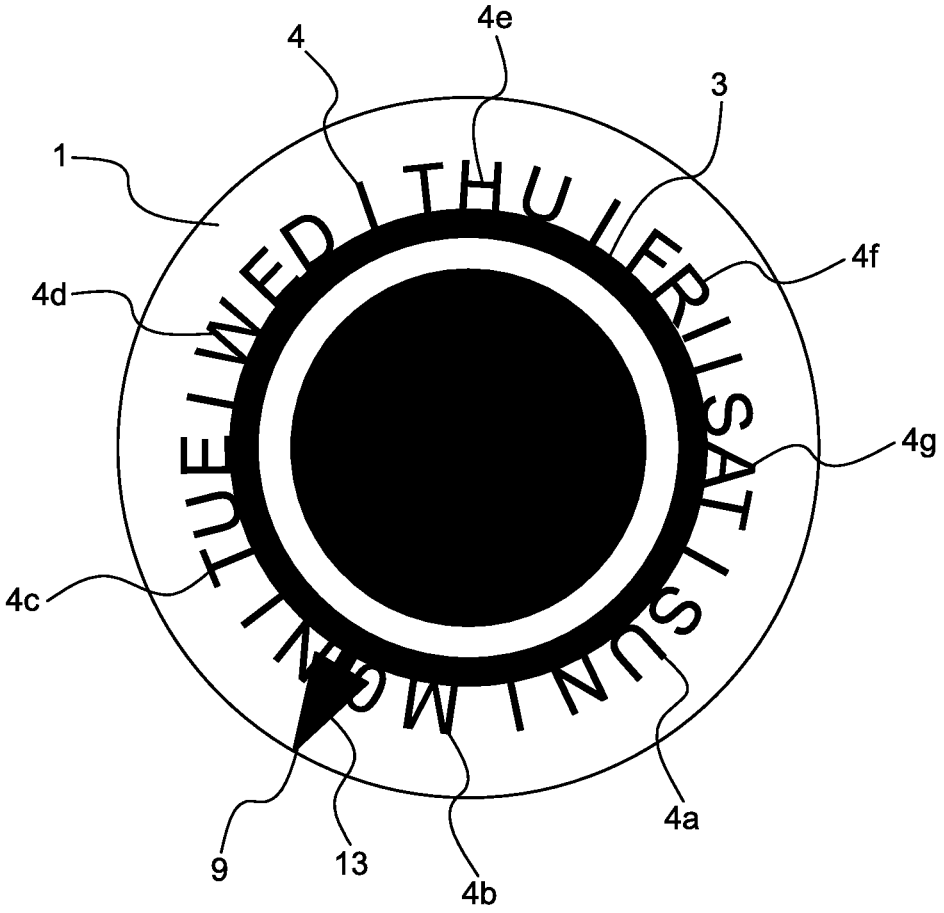
FIG. 1 shows a top plan view of an exemplary medication reminder system according to an embodiment of the present disclosure.

Exemplary embodiments disclosed herein describe a medication reminder device. The device includes a ring rotatably engaged to a neck area of a container to indicate a time for a next medication dosage, the ring having a plurality of internal locking members which each rotationally engage at least one of a plurality of protuberances located along the neck area of the container to lock the ring in a desired rotated position, the ring having at least one external member which points to indicia located at a shoulder area of the container, the indicia are time indicators located at rotational positions along a circumference of the shoulder area of the container.

In some exemplary embodiments, the rotational engagement of each locking member with at least one of the plurality of protuberances creates interference in the rotational movement of the ring such that the ring is locked in the desired position.

In some exemplary embodiments, the plurality of protuberances creates grooves along the neck area of the container, one groove is created between each protuberance.

In some exemplary embodiments, at least one external member is a pointer which extends outward from the ring such that the distal end of the pointer reaches the outside perimeter of the shoulder area.

In some exemplary embodiments, the plurality of locking members are teeth located along the inside edge of the ring.

In some exemplary embodiments, the teeth located along the inside edge of the ring are each rotationally engaged with at least one of the plurality of protuberances at a rotational position that allows the pointer to point to a desired time indicator.

In some exemplary embodiments, the teeth are each locked at the rotational position by maintaining their positions in a corresponding groove adjacent to at least one plurality of protuberances to which each tooth is rotationally engaged.

In some exemplary embodiments, the ring is rotatably engaged to a distal end of the neck area, the distal end is located just below where a cap to be attached to the container and the container create a closure.

In some exemplary embodiments, the shoulder area is the region located immediately below the neck area where the diameter of the container is substantially larger than the diameter of the neck area.

In some exemplary embodiments, the time indicators include at least one from the group comprising i) days of the week ii) hours of a day iii) days of the week and hours of the day.

Other exemplary disclosed embodiments describe a medication reminder system. The medication reminder system includes a container and a ring. The container has a plurality of protuberances located along a neck area which creates a groove between each protuberance, and the container includes indicia located along a shoulder area, the indicia are time indicators located at rotational positions along a circumference of the shoulder area. The ring has a plurality of internal locking members which each rotationally engage at least one of the plurality of protuberances to lock the ring in a desired position. The ring has at least one external member which points to the indicia.

In some exemplary embodiments, the rotational engagement of each locking member with at least one of the plurality of protuberances creates interference in the rotational movement of the ring such that the ring is locked in the desired position.

In some exemplary embodiments, at least one external member is a pointer which extends outward from the ring such that the distal end of the pointer reaches the outside perimeter of the shoulder area.

In some exemplary embodiments, the plurality of locking members are teeth located along an inside edge of the ring.

In some exemplary embodiments, the teeth located along the inside edge of the ring are each rotationally engaged with at least one of the plurality of protuberances at a rotational position that allows the pointer to point to a desired time indicator.

In some exemplary embodiments, the teeth are each locked at the rotational position by maintaining their positions in a corresponding groove adjacent to at least one plurality of protuberances to which each tooth is rotationally engaged.

DETAILED DESCRIPTION

Figure 2:
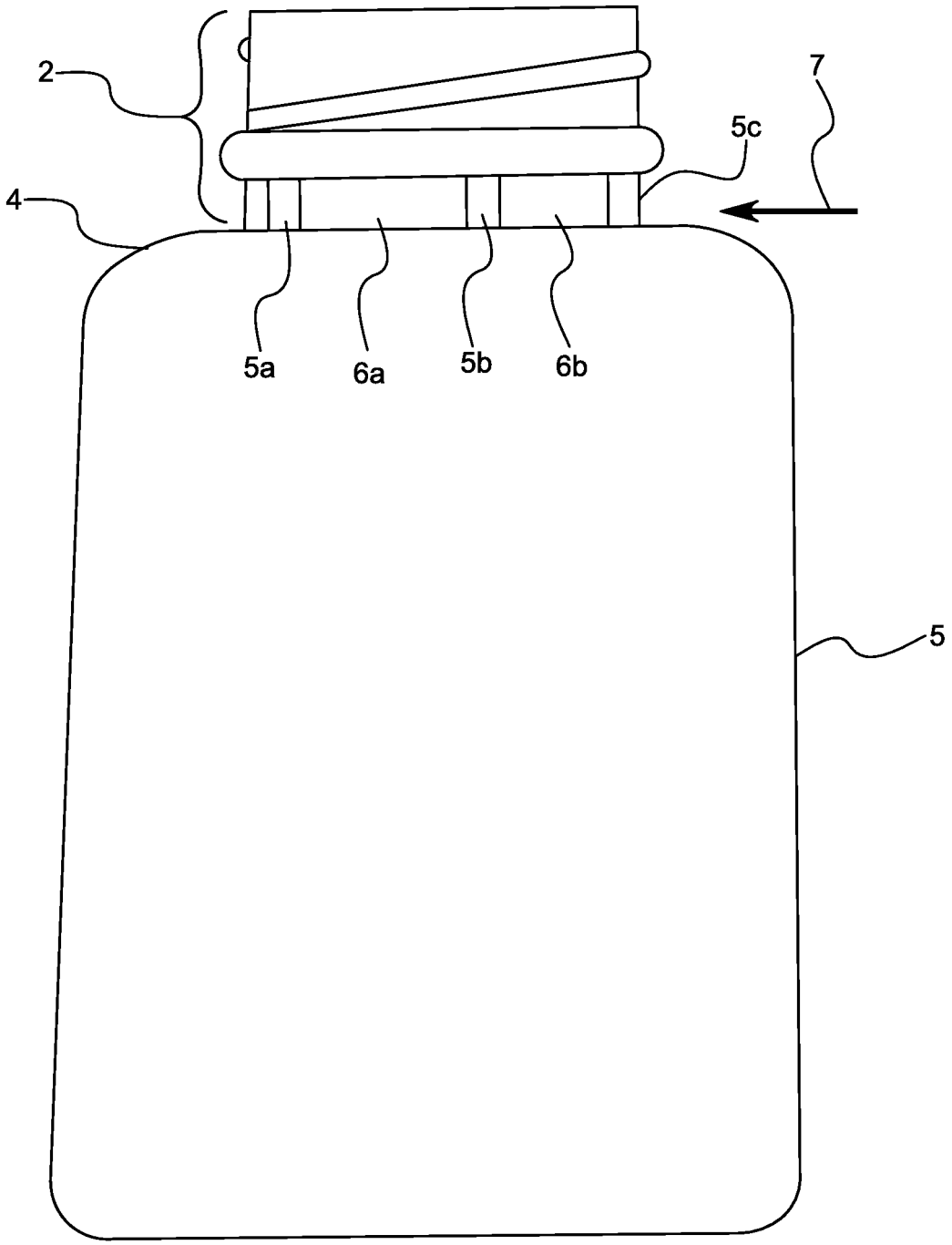
FIG. 2 shows an exemplary container included in the medication reminder system according to an embodiment of the present disclosure.
Figure 3:
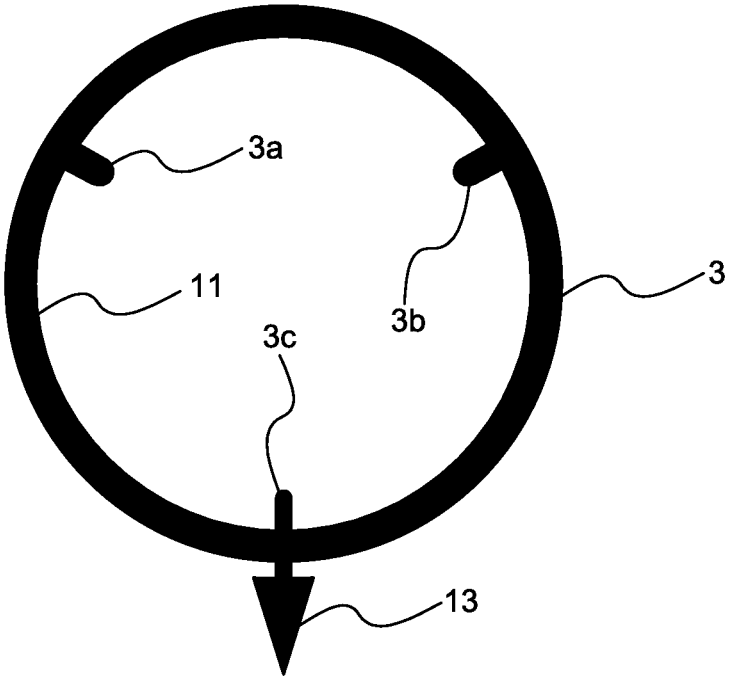
FIG. 3 shows an exemplary reminder ring included in the medication reminder system according to an embodiment of the present disclosure.

The present disclosure relates to a medication reminder system which is used to remind a user of the next time to take a medication dosage. A medication can include prescription drugs, over the counter drugs, vitamins, herbal supplements or any other suitable types of supplements or drugs. As illustrated in FIGS. 1-3, the medication reminder system 1 includes a ring 3 and a container 5. The ring attaches to the distal end 7 of neck area 2 of the container and operates as a dial, moving from one position to a next position along the shoulder area 4 of the container 5 based on rotational movement by a user. Each position along the shoulder area 4 of the container 5 includes indicia 4*a*-4*f* and each operates as an indicator of time for a next medication dosage. When a user takes a dose of the medication contained in the container, the user dials (i.e., rotates) the ring to a next dosage time indicator position.

The ring 3 includes a plurality of internal locking members 3*a*, 3*b*, 3*c*, which are located along the inside edge 11 of the ring. Although FIG. 3 illustrates the ring including three locking members, one of ordinary skill would know that any suitable number of internal locking members can be used. In a preferred embodiment, the internal locking members are teeth (i.e. an outward projecting physical structure which meshes or engages with a mating physical structure).

The ring 3 includes at least one external member 13 which points to indicia 4*a*-4*f* when the ring is attached to container 5. In a preferred embodiment the external member 13 is a pointer which extends outward from the ring such that the distal end 9 of the pointer reaches the perimeter of the shoulder area 4 of container 5. The ring can be made of any suitable material, including, for example, plastic. The ring can be of any color. In a preferred embodiment, the ring is red.

The container 5 may include any suitable enclosure for holding medications. The container includes a neck area 2 and a shoulder area 4. The distal end 7 of the neck area 2 is located just below where a cap to be attached to the container and the container create a closure. The shoulder area 4 of the container is the region located immediately below the neck area where the diameter of the container is substantially larger than the diameter of the neck area.

The distal end 7 of the neck area 2 includes a plurality of protuberances 5*a*-5*n* (elements 5*d*-5*n* are not visible in the Figures). In some exemplary embodiments, the number of protuberances may equal the number of indicia located along the shoulder area 4. The plurality of protuberances creates grooves 6*a*-6*f* (elements 6*c*-6*f* are not visible in the Figures) along the neck area 2 of the container, one groove is created between each protuberance. In some exemplary embodiments, the number of grooves may equal the number of indicia located along the shoulder area of the container.

The shoulder area 4 of container 5 includes indicia 4*a*-4*f* The indicia are time indicators located at rotational positions along a circumference of the shoulder area 4 of the container. The indicia may include the days of the week. In some exemplary embodiments, the indicia may include the days of the week with the day and night, the hours of the day, days of the week and hours of the day or any other suitable reference to time.

The internal locking members 3*a*-3*c* rotationally engage at least one of the plurality of protuberances 5*a*-5*n* located on the container to lock the ring 3 in a desired rotated position. The internal locking members rotationally engage one of the protuberances at a rotational position along the shoulder 4 that allows the pointer 13 to point to a desired time indicator. The internal locking members are each locked at the rotational position by maintaining their positions within a corresponding groove adjacent to the at least one protuberance to which each internal locking member is rotationally engaged.

In an exemplary embodiment, the medication reminder system 1 is made from 100% recyclable materials.

The disclosed embodiments are not inclusive and many other modifications and variations will be apparent to someone of ordinary skill in the art with construction skills in the related arts. Together the descriptions and accompanying illustrations seek to provide an explanation of the basic principles of the embodiment and its application. It is therefore intended that the specification and embodiments be considered as exemplary only.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A medication reminder system comprising:

a container including a plurality of protuberances located along a neck area which creates a groove between each protuberance, and including indicia located along a shoulder area of the container, the indicia are time indicators located at rotational positions along a circumference of the shoulder area; and a ring configured to fit around a neck area of a container and to rotate around the neck area of the container to indicate a time for a next medication dosage, the ring having ternary internal locking members, each internal locking member is positioned along the inside edge of the ring and extends outwards from the inside edge of the ring in a perpendicular direction, and wherein each internal locking member is configured to engage at least one of a plurality of protuberances located along the neck area of the container upon rotation of the ring to lock the ring in a desired position, the ring having at least one external member including an arrow which points to indicia located at a shoulder area of the container, the indicia are time indicators located at rotational positions along a circumference of the shoulder area of the container.

2. The medication reminder system of claim 1, wherein the rotational engagement of each locking member with at least one of the plurality of protuberances creates interference in the rotational movement of the ring such that the ring is locked in the desired position.

3. The medication reminder system of claim 1, wherein the at least one external member is a pointer which extends outward from the ring such that the distal end of the pointer reaches the outside perimeter of the shoulder area.

4. The medication reminder system of claim 1, the plurality of locking members are teeth located along an inside edge of the ring.

5. The medication reminder system of claim 4, wherein the teeth located along the inside edge of the ring are each rotationally engaged with at least one of the plurality of protuberances at a rotational position that allows the pointer to point to a desired time indicator.

6. The medication reminder system of claim 4, wherein the teeth are each locked at the rotational position by maintaining their positions in a corresponding groove adjacent to the at least one plurality of protuberances to which each tooth is rotationally engaged.

* * * * *